US006691342B2

(12) United States Patent
Sherman

(10) Patent No.: US 6,691,342 B2
(45) Date of Patent: Feb. 17, 2004

(54) CONVERTIBLE FURNITURE

(76) Inventor: Loren Sherman, 685 W. End Ave., No. 1B, New York, NY (US) 10025

( * ) Notice: Subject to any disclaimer, the term of this patent is extended or adjusted under 35 U.S.C. 154(b) by 59 days.

(21) Appl. No.: 10/161,354

(22) Filed: Jun. 3, 2002

(65) Prior Publication Data

US 2002/0148041 A1 Oct. 17, 2002

Related U.S. Application Data

(63) Continuation-in-part of application No. 09/662,537, filed on Sep. 15, 2000, now Pat. No. 6,401,276, which is a continuation-in-part of application No. 09/476,757, filed on Jan. 3, 2000, now abandoned.

(51) Int. Cl.[7] ..... A47C 17/42; A47C 17/40

(52) U.S. Cl. ..... 5/136; 5/2.1; 5/133; 5/164.1

(58) Field of Search ..... 5/136, 133, 159.1, 5/2.1, 160, 161, 164.1

(56) References Cited

U.S. PATENT DOCUMENTS

| | | | | | |
|---|---|---|---|---|---|
| 244,566 | A | * | 7/1881 | Doring | 5/2.1 |
| 562,269 | A | * | 6/1896 | Auerbach | 5/167 |
| 1,419,586 | A | * | 6/1922 | Plackard | 5/2.1 |
| 1,915,507 | A | * | 6/1933 | Wright | 5/133 |
| 2,564,512 | A | * | 8/1951 | Specht | 5/2.1 |
| 2,671,230 | A | * | 3/1954 | Potter | 5/141 |
| 2,770,813 | A | * | 11/1956 | Marzillier | 5/2.1 |
| 3,088,127 | A | * | 5/1963 | Eames | 5/2.1 |
| 3,858,253 | A | * | 1/1975 | Lauzon | 5/2.1 |
| 4,070,715 | A | * | 1/1978 | Reppas | 5/2.1 |
| 4,885,813 | A | * | 12/1989 | McNamara | 5/136 |
| 5,446,932 | A | * | 9/1995 | Voorhis | 5/137 |
| 5,652,978 | A | * | 8/1997 | Wiig | 5/144 |
| 6,401,276 | B1 | * | 6/2002 | Sherman | 5/136 |
| 2002/0148041 | A1 | * | 10/2002 | Sherman | 5/9.1 |

* cited by examiner

*Primary Examiner*—Robert G. Santos
(74) *Attorney, Agent, or Firm*—Notaro & Michalos P.C.

(57) ABSTRACT

Convertible furniture unit has a base and a bed platform connected to the base for displacement about a first axis from a stowed position to a use position. The platform is adapted to support a mattress. A table panel is pivotally mounted to the platform for displacement about a second axis between a support and a use position. An extension is pivotally connected to the table panel for rotation of the extension between an upper position for propping the panel in its working position, and a lower position. The extension pivots on a spreader fixed to the base. The spreader also contains a spring and optional linear actuator for controlling displacement of the platform.

30 Claims, 4 Drawing Sheets

CONVERTIBLE FURNITURE

CROSS-REFERENCE TO RELATED APPLICATION

This is a continuation-in-part of U.S. patent application Ser. No. 09/662,537 filed Sep. 15, 2000 and now U.S. Pat. No. 6,401,276, which was a continuation-in-part of U.S. patent application Ser. No. 09/476,757 filed Jan. 3, 2000 and now abandoned. Both prior applications are incorporated here by reference.

FIELD AND BACKGROUND OF THE INVENTION

The present invention relates in general to convertible furniture, and in particular, to a new and useful furniture unit that converts from a bed to a table or desk, and back.

Convertible furniture is commonly utilized as a space-saving expedient, for example, in living quarters having limited space, such as in studios and in small apartments that are frequently found in densely populated urban areas. A typical example of such convertible furniture is the conventional sofa-bed which provides a sofa in one mode and a bed frame and mattress in another mode.

Convertible furniture which converts from a bed to a desk may also be used in larger homes for double-use rooms, such as a guest room/home office combination.

A convertible furniture unit having both a desk and a bed function is illustrated in U.S. Pat. No. 4,318,195. This furniture unit does not provide a minimal storage profile and is cumbersome to operate. It also does not include the convenience of a headboard.

U.S. Pat. No. 2,671,230 discloses a wall bed which employs tension springs to facilitate movement of the bed between stowed and open positions. The hinged leg assembly support for this bed frame and its chain support for a shelf have only moderate weight-bearing capacity and rather limited stability. A multi-functional convertible furniture construction is disclosed in U.S. Pat. No. 5,101,523. It incorporates a bed frame within a shelving unit. A movable extension attached to a spool in this construction must be unrolled to support a mattress. The mattress must also be foldably stored.

Also see U.S. Pat. Nos. 2,770,813; 3,088,127; 4,070,715; 4,476,592; 5,136,737 and 5,621,930 for other examples of convertible furniture units having a bed position.

SUMMARY OF THE INVENTION

The present invention is a further refined convertible piece of furniture that has a base, a bed platform pivotally connected to the base for pivoting about a first axis from a stowed position to a use position, and a table, desk or work surface panel pivotally mounted to an underside of the platform for displacement about a second axis that is spaced from the first axis so that the panel is in a support position when the platform is in the use position, and the panel is in a working position when the platform is in the stowed position. An extension is pivotally connected to the panel about a third axis at a location spaced from the first and second axes, for rotation of the extension between an upper position for propping the panel in its working position, and a lower position. The extension includes a part for propping the panel and another part for extending the useful surface of the panel.

The table, desk or work surface panel can be a solid board, an engineered panel of laminates and frame elements, or a three-dimensional structure with spaces for drawers, storage areas and the like. It can be used as a dining table, writing table, desk, work surface or similar article of furniture.

Concurrently with movement of the bed platform, a headboard can be deployed for the bed platform. A fixed spreader extends forwardly of the base for stabilizing the furniture unit. The extension is mounted for movement between a far end of the spreader and the panel. The spreader extends under the panel permanently to support the panel in both its working and support positions, and houses tensioning and/or actuation means for controlling movement of the platform between its stowed and use positions. The fixed spreader also allows the piece of furniture to be free-standing.

The invention provides a convertible furniture unit that is simple in design, rugged in construction and economical to manufacture.

The various features of novelty which characterize the invention, are pointed out with particularity in the claims annexed to, and forming a part of this disclosure. For a better understanding of the invention, its operating advantages and specific objects attained by its uses, reference is made to the accompanying drawings and descriptive matter, in which preferred embodiments of the invention are illustrated.

DESCRIPTION OF THE PREFERRED EMBODIMENTS

Figure 1:
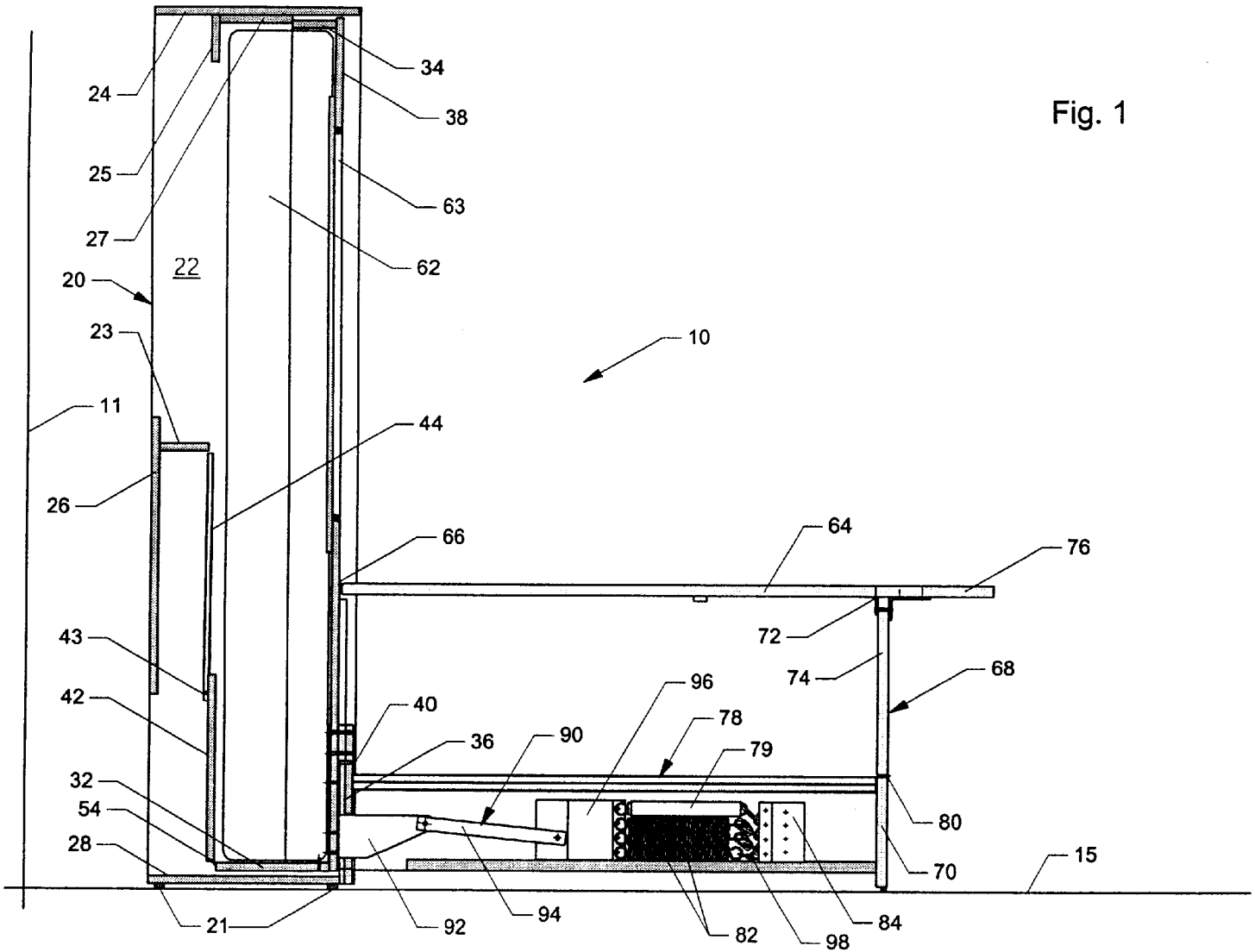
FIG. 1 is a side sectional view of a convertible furniture unit in accordance with the invention with a bed platform in a stowed position and a table panel in a use position.

Referring now to the drawings in which the same reference numerals are used to designate the same or functionally similar parts, the invention embodied FIG. 1 comprises a convertible piece of furniture or furniture unit generally designated 10 including a base generally designated 20 having two spaced-apart upright side panels 22 (only one is shown) and a back panel 26 that is connected to, and extends between the side panels 22. The side panels are also connected to each other at the top by a top panel 24, and at the bottom by a bottom panel 28.

Back panel 26, as shown, does not extend the full height of the side panels 22. The area below the back panel 26 can be exposed or need not be exposed, when the furniture unit 10 is in either of its functional modes shown respectively in FIGS. 1 (bed platform in use position) and 2 (table panel in use position). The furniture unit 10 may also be placed adjacent a wall 11 or provided with a full height back panel (not shown) if the furniture unit is to be used as a room divider.

Six levelers 21 are provided on the four corners of an undersurface of bottom panel 28, to level the base 20 on the floor 15. A valence plate 25 and a subtop plate 27 strengthen the top panel 24, and are also fixed between the side panels 22. Subtop plate 27 also limits the stowed position of the mattress 62 in base 20.

Figure 2:
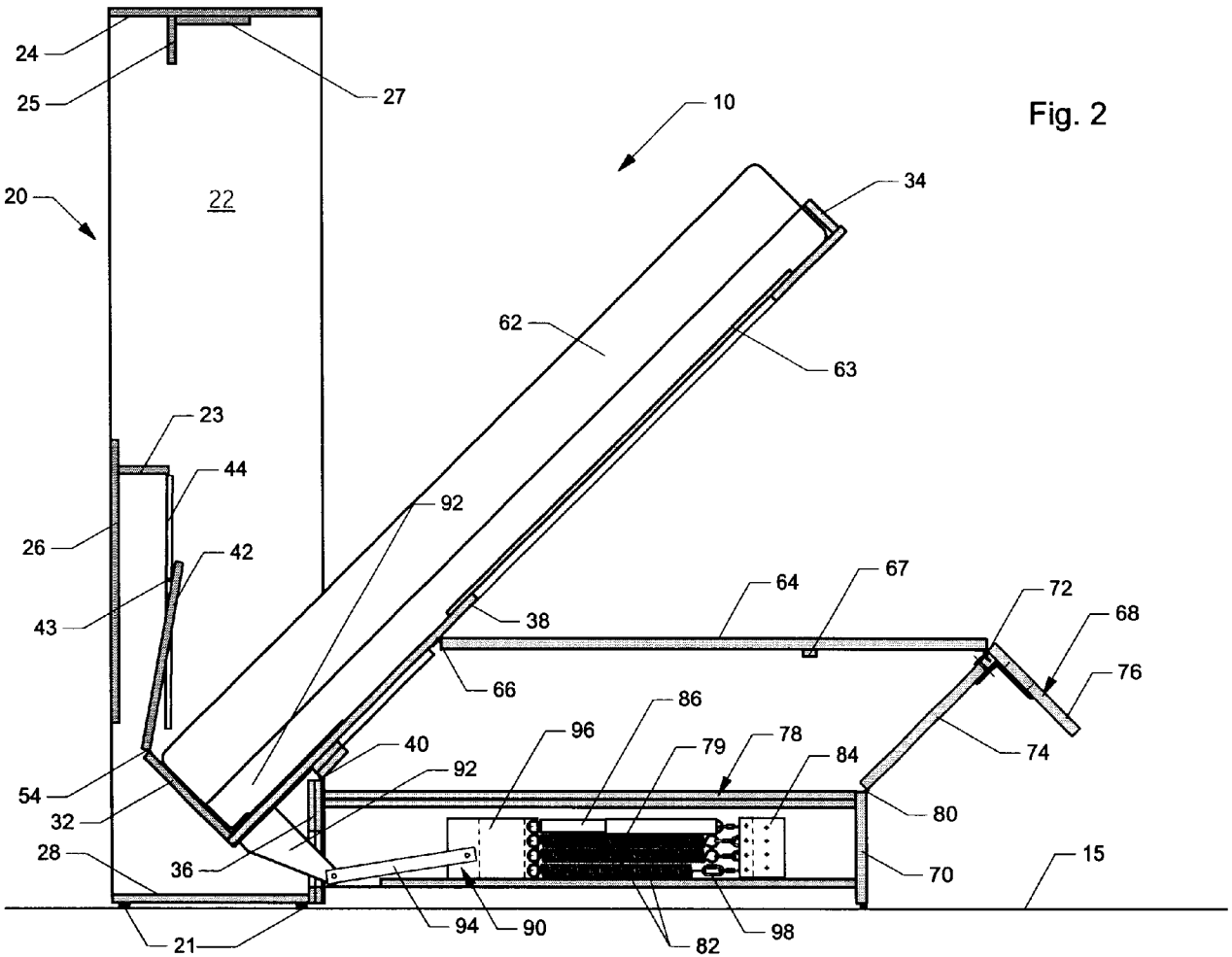
FIG. 2 is a view similar to FIG. 1 of the unit is a transitional position for the platform and panel, and illustrating an alternate embodiment of the invention.
Figure 3:
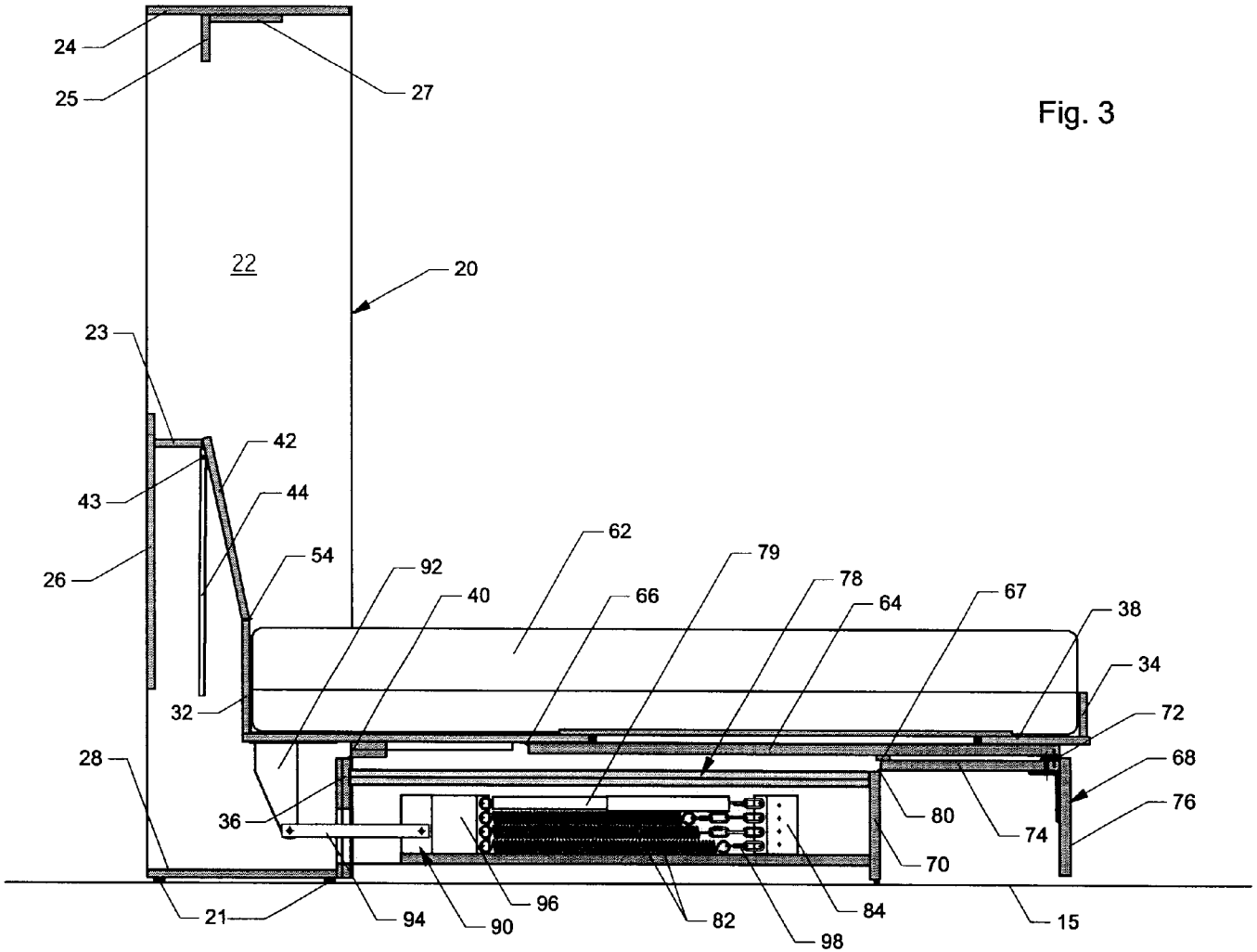
FIG. 3 is a view similar to FIG. 1 showing the unit in a use position for the bed platform and a support position for the table panel.
Figure 5:
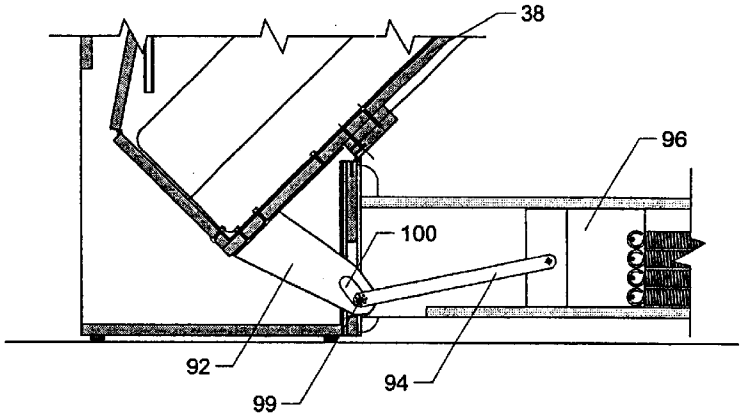
FIG. 5 is a view similar to FIG. 4 with the platform in an intermediate position.
Figure 7:
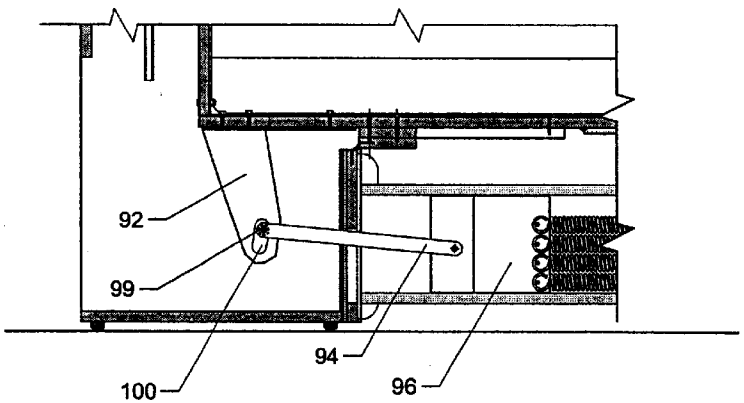
FIG. 7 is a view similar to FIG. 4 with the platform in a fully lowered position.
Figure 4:
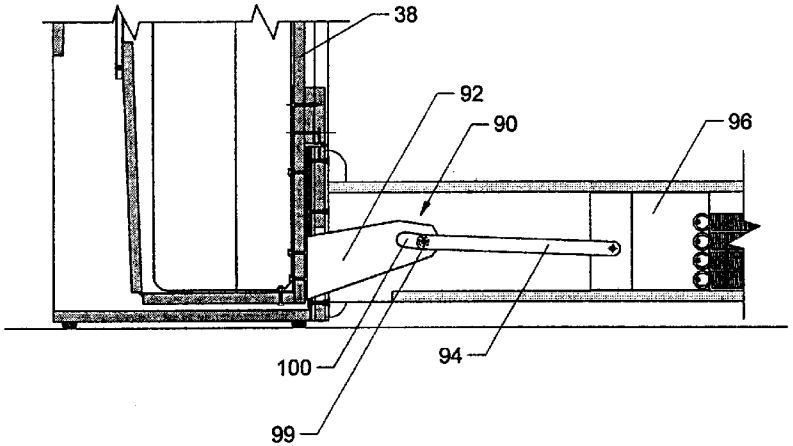
FIG. 4 is a partial side sectional view of another embodiment of a platform linkage mechanism for helping raise and lower the mattress platform of the invention, in a raised position.
Figure 6:
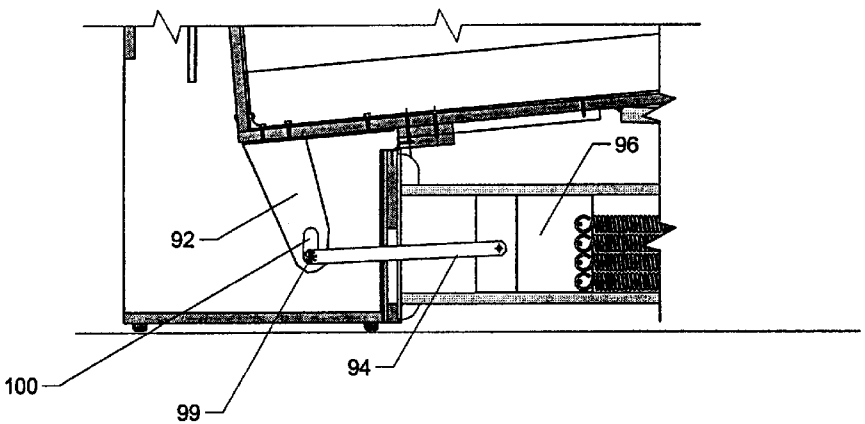
FIG. 6 is a view similar to FIG. 4 with the platform in a low position.

A planar bed platform 38 is pivotally connected, e.g. by a piano or other hinge arrangement at a first axis 40, to the top of a front sill plate 36 that is connected between the side panels 22 of the base 20, for movement about this horizontal axis 40, between a substantially vertical, stowed position in FIG. 1, down through a transitional position in FIG. 2, to a lowered, substantially horizontal use position in FIG. 3.

Mattress 62 is supported on a support surface of platform 38, and is held in place between a head rail 32 and a foot rail 34. Rails 32, 34 are fixed to, and extend outwardly from the support surface of platform 38.

A headboard 42 is pivotally connected at hinge 54, to a top edge of head rail 32 and has a pair of side projections, rods or trunnions 43 that ride in a pair of opposite headboard guide tracks extending downwardly from an outer edge of a shelf panel 23 attached between the side panels 22. The guide tracks 44 are routered, cut or otherwise provided on inner surfaces of the respective side panels 22, or may be separate metal or other U-shaped track members fixed to inner surfaces of the side panels.

In the stowed position of the bed platform (FIG. 1) headboard 42 extends substantially vertically in base 20. As platform 38 moved to its lowered, use position (FIG. 2 then FIG. 3) the headboard projections or rods 43 ride up tracks 44 until, in the use position of FIG. 3, the top edge of headboard 42 meets the outer edge of shelf 23 and the headboard extends at an angle in a usual fashion for a headboard-with-shelf combination.

A table, desk or work surface panel 64 (called a table panel for this disclosure), has an inner edge which is pivotally connected by a hinge, to an underside of the bed platform 38, for displacement about a second axis 66 that is spaced from the first axis 40 so that the table panel is in a support position shown in FIG. 3, when the platform is in the use position. The table panel is in a working or use position as shown in FIG. 1, when the platform is in the stowed position.

An extension generally designated 68 is pivotally connected at another hinge to the outer edge of table panel 64, about a third axis 72 at a location spaced from the first and second axes 40, 66, for rotation of the extension between an upper position of FIG. 1, for propping the table panel 64 in its working position, and a lower position shown in FIG. 3. The extension 68 includes a propping portion 74 for propping the outer end of table panel 64 in its use position of FIG. 1, and another work surface portion 76 for extending the useful surface of the table panel 64 in the use position.

The panel 64 has upper and lower surfaces and the second axis 66 is adjacent the upper surface of the panel while the third axis 72 is adjacent the lower surface of the panel. This, with a proper spacing of the various pivot axes, permits the table panel to fold down into its support position.

In the support position of the table panel in FIG. 3, no part of the work surface portion 76 touches the floor 15 to avoid an unstable condition. An unstable condition would occur on uneven floors if a lower leg panel 70 to be described later, is slightly too short so that the lower edge of portion 76 in FIG. 3 touches the floor. This was found to cause the furniture unit to rock in an unstable manner as either the foot 70 or the extension portion 76 touched the floor 15.

The furniture unit 10 of the present invention is self supporting (although base 20 may be attached to wall 11 if desired) because of the presence of a fixed spreader 78 extends forwardly of the base 20 for stabilizing the furniture unit 10.

The spreader 78 extends under the table panel 64 permanently to support the panel in both its working and support positions. Spreader 78 is shaped to house tensioning and/or actuation means generally designated 79, for controlling movement of and bearing at least some of the weight of the bed platform as it moves between the platform's stowed and use positions. The fixed spreader also prevents the unit from tipping forward in any position of the bed platform and table panel, and thus allows the piece of furniture to be free-standing is desired.

Foot 70 is fixed to and forms the outer part of the spreader 78. Foot 70 is connected to and supports the propping portion 74 of extension 68 as noted, for fixing the spacing between the base 20 and the extension.

The tensioning and/or actuation means 79 are housed in the box-like spreader 78 and are connected to the platform for resisting displacement of the platform from the upright stowed position, to the lowered use position.

The work surface portion 76 is fixed to and extends from the propping portion 74 at a right angle so that the extension 68 is L-shaped. The propping portion 74 is pivotally connected at a fourth axis 80, to the foot 70 and this fourth axis is spaced from the third axis 72 by a distance that is equal to the length of propping portion 74.

The tensioning means 79 comprises at least one spring 82 having one end connected to a fixed block 84 in the spreader 78, and an opposite end connected to the platform 38 through a linkage generally designated 90.

Before discussing the linkage 90 in greater detail, it is noted that the table panel 64 may contain at least one space for storage or a drawer, and/or the bed platform may include a recess 63 in its opposite or lower surface for defining a space between the platform and the panel in the lowered use position of the platform, e.g. for containing a mirror, a pegboard, or the like. Recess 63 although shallow, may also allow thin items such as pads of paper or the like, remain on the top surface of table panel 64, even while the bed platform is lowered to its use position. One or more spacers 67 are also provided on the undersurface of panel 64 to support the panel in its lower support position of FIG. 3.

The linkage 90 includes one or more lever arms 92 extending outwardly from the opposite or lower surface of the platform 38, and one or more mending plates or connecting arms 94. One or more openings are provided in sill plate 36 to allow level 92 to rotate between the use and stowed positions of the bed platform 38. The linkage means 90 also includes a sliding block 96, slidably mounted in the spreader 78 and connected between the connecting arm(s) 94 and the lever(s) 92.

At least one chain link 98 may also be connected between one or more of the springs 82 and one of the blocks 84 or 96, so that at least one of the springs acts to resist the displacement of the bed platform only after another of the springs has already begun to stretch. This causes a staging effect which engages more spring force as the bed platform is lowered and more force is needed to restrain the platform. In this way the biasing force is easily tailored to the force needed.

In the embodiment of FIG. 2, a top one of the springs 82 is replaced by a linear actuator 86 that is connected between the blocks 84, 96 for actively moving the platform between its positions. The actuator 86 may be a piston/cylinder combination or a linear actuator of any appropriate type and allows the unit of the invention to automatically move between its first and second functional modes, to convert between a table and a bed. This automatic action may even be controlled remotely by any number of known remote control mechanisms.

A damper could also be used to safely control the speed of descent of the bed platform. This could be in place of one of the springs also, or in combination with the springs and a linear motor.

FIGS. 4 to 7 illustrate another embodiment of the linkage or linkage means 90. In this embodiment a roller, slide or other moving connector 99, rides in a curved slot 100 to mechanically and dynamically connect lever arm 92 to connecting arm 94 and the sliding block 96. The center of curvature of slot 100 is far to the left in FIGS. 4 to 7, so that the curvature is slight and convex toward block 96. In the stowed position for the mattress platform 38 in FIG. 4, moving connector 99 is at the bottom of slot 100. It stays there as the platform 38 is lowered (FIG. 5) and even near its lowest position (FIG. 6) connector 99 stays at the bottom of slot 100. Just as the platform 38 approaches its lowered, use position shown in FIG. 7, the dynamic position of connector 99 moves up the curved slot 100 and comes to rest at the top of the slot. The curvature of slot 100 prevents the movement of connector 99 from one end of the slot 100 to the other, from being too abrupt, and this movement helps shift the load exerted on the platform by the springs in an advantageous manner.

While specific embodiments of the invention have been shown and described in detail to illustrate the application of the principles of the invention, it will be understood that the invention may be embodied otherwise without departing from such principles.

What is claimed is:

1. A convertible furniture unit, comprising:

a base;

a platform pivotally connected to the base for displacement about a first axis from an upright stowed position, to a lowered use position, the platform having an upper surface in the use position adapted to support a mattress, and an opposite surface;

a panel pivotally mounted to the opposite surface of the platform for relative displacement between the platform and the panel about a second axis which is spaced from the first axis so that the panel is in a support position when the platform is in the use position, the panel being in a working position when the platform is in the stowed position;

an extension pivotally connected to the panel at a third axis that is spaced from the second axis, for rotation of the extension between an upper position for propping the panel in its working position, and a lower position;

a spreader connected between the base and the extension for fixing a spacing between the base and the extension; and tensioning means in the spreader and connected to the platform for resisting displacement of the platform from the upright stowed position, to the lowered use position.

2. A unit according to claim 1, wherein the extension includes a propping portion and a work surface portion fixed to and extending from the propping portion at an angle, the extension being pivotally connected to the panel at the third axis, and the spreader having a foot pivotally connected at a fourth axis to the propping portion, the fourth axis being spaced from the third axis.

3. A unit according to claim 1, wherein the work surface portion does not touch the ground when the extension is in its lower position.

4. A unit according to claim 1, wherein the tensioning means comprises at least one spring having one end connected to the spreader and an opposite end connected to the platform.

5. A unit according to claim 1, wherein the panel has upper and lower surfaces, the second axis being adjacent the upper surface of the panel and the third axis being adjacent the lower surface of the panel.

6. A unit according to claim 1, including a headboard movably mounted between the base and the platform for forming a headboard when the platform is in the use position.

7. A unit according to claim 6, wherein the platform includes a head rail fixed to the platform at a location adapted to establish a mattress position on the platform, the headboard being pivotally connected to the head rail.

8. A unit according to claim 7, including means defining at least one guide fixed to the base, the headboard being slidable along the guide between the stowed position and the use position of the platform.

9. A unit according to claim 1, wherein the panel contains at least one space for storage.

10. A unit according to claim 1, wherein the platform includes a recess in its opposite surface for defining a space between the platform and the panel in the lowered use position of the platform.

11. A unit according to claim 1, including a fixing block in the spreader, the tensioning means comprises at least one spring having one end connected to the fixing block and an opposite end connected to the platform.

12. A unit according to claim 11, including a lever arm extending outwardly from the opposite surface of the platform, and a connecting arm connected between the at least one spring and the lever arm.

13. A unit according to claim 12, wherein the tensioning means includes a sliding block slidably mounted to the spreader and connected to the connecting arm, the at least one spring being connected between the fixing and sliding blocks.

14. A unit according to claim 13, wherein the tensioning means includes a sliding dynamic connection between the connecting arm and the lever arm.

15. A unit according to claim 13, including a plurality of said springs connected between the blocks and at least one chain link connected between one of the springs and one of the blocks so that the one of the springs acts to resist displacement of the platform only after another of the springs has acted.

16. A unit according to claim 13, including a linear actuator connected between the blocks for moving the platform.

17. A furniture unit, comprising: a bed platform pivotally connected to a base member for angular displacement about a horizontal axis from an upright stowed position to a substantially horizontal first functional mode, the bed platform being adapted to support a mattress on an upper surface thereof, a table panel mounted along a first edge thereof to an underside of the bed platform for angular displacement about a horizontal axis when the bed platform is in the stowed position, to a second functional mode, the table panel including an extension pivotally connected to a second edge of the table panel, said extension having a depending leg panel adapted to support the table panel in the second functional mode, the extension and table panel being pivotally foldable to a platform support mode when the bed platform is displaced to the first functional mode, a spreader connected between the base member and the extension for fixing a spacing between the base and at least part of the extension, and means in the spreader for transmitting a force to the bed platform to provide a mechanical assist upon lowering and raising the bed platform.

18. A unit according to claim 17, wherein the extension includes a propping portion and an extension portion fixed to and extending from the propping portion at an angle and a foot fixed to the spreader and pivotally connected to the propping portion.

19. A unit according to claim 18, wherein the extension portion does not touch the ground when the extension is in its lower position.

20. A unit according to claim 17, wherein the means has one end connected to the spreader and an opposite end connected to the platform.

21. A unit according to claim 17, including a headboard movably mounted between the base member and the platform for forming a headboard when the platform is in the horizontal first functional mode.

22. A unit according to claim 21, wherein the bed platform includes a head rail fixed to the platform at a location adapted to establish a mattress position on the platform, the headboard being pivotally connected to the head rail.

23. A unit according to claim 22, including guide means defining at least one guide fixed to the base member, the headboard being slidable along the guide between the stowed position and the first functional mode of the platform.

24. A unit according to claim 17, wherein the panel contains at least one space for storage.

25. A unit according to claim 17, wherein the platform includes a recess in its opposite surface for defining a space between the platform and the panel in the lowered position of the platform.

26. A unit according to claim 17, including a fixing block in the spreader, the means having one end connected to the fixing block and an opposite end connected to the platform.

27. A unit according to claim 26, including a lever arm extending outwardly from the opposite surface of the platform, and a connecting arm connected to the means.

28. A unit according to claim 27, including a sliding block slidably mounted to the spreader and a plurality of springs forming the means connected between the fixing and sliding blocks.

29. A unit according to claim 28, including at least one link connected between one of the springs and one of the blocks so that the one of the springs acts to resist the displacement only after another of the springs acts.

30. A unit according to claim 28, including a linear actuator connected between the blocks for moving the platform.

* * * * *